US010113309B2

(12) United States Patent
Anderson, Jr. et al.

(10) Patent No.: US 10,113,309 B2
(45) Date of Patent: Oct. 30, 2018

(54) FLOOD VENT BARRIER SYSTEMS

(71) Applicant: Smart Vent Products, Inc., Pitman, NJ (US)

(72) Inventors: Winfield Scott Anderson, Jr., Palm Beach Gardens, FL (US); Tom Little, Pitman, NJ (US); James Rycek, Pitman, NJ (US); Michael J. Graham, Pitman, NJ (US)

(73) Assignee: Smart Vent Products, Inc., Pitman, NJ (US)

( * ) Notice: Subject to any disclaimer, the term of this patent is extended or adjusted under 35 U.S.C. 154(b) by 0 days.

(21) Appl. No.: 14/681,213

(22) Filed: Apr. 8, 2015

(65) Prior Publication Data

US 2016/0298380 A1 Oct. 13, 2016

(51) Int. Cl.
*F24F 13/20* (2006.01)
*E04B 1/70* (2006.01)

(52) U.S. Cl.
CPC ..... *E04B 1/7076* (2013.01)

(58) Field of Classification Search
CPC ..... F24F 13/20
USPC ..... 454/275, 276
See application file for complete search history.

(56) References Cited

U.S. PATENT DOCUMENTS

| | | | | |
|---|---|---|---|---|
| 73,159 A | | 1/1868 | Besse | |
| 100,623 A | | 3/1870 | Hays | |
| 314,865 A | | 3/1885 | Monger | |
| 735,053 A | | 8/1903 | Bates | |
| 850,441 A | | 4/1907 | McGinnis | |
| 911,290 A | | 2/1909 | Burkett | |
| 1,089,232 A | | 3/1914 | Larson | |
| 1,863,791 A | * | 6/1932 | Heise | H01M 6/22 423/641 |
| 2,105,735 A | * | 1/1938 | Hodge | B65D 90/34 292/265 |
| 2,118,535 A | | 5/1938 | Betts | |
| 2,565,122 A | * | 8/1951 | Cowan | E04C 1/42 454/273 |
| 2,611,310 A | * | 9/1952 | Cowan | E04C 1/42 454/273 |

(Continued)

FOREIGN PATENT DOCUMENTS

| | | |
|---|---|---|
| GB | 2147933 | 5/1985 |
| JP | 55-085720 | 6/1980 |
| JP | 04-203112 | 7/1992 |

OTHER PUBLICATIONS

Smart Vent, web pages from www.smartvent.com, printed Apr. 6, 2015.

(Continued)

*Primary Examiner* — Steven B McAllister
*Assistant Examiner* — Samantha Probst
(74) *Attorney, Agent, or Firm* — Akerman LLP

(57) ABSTRACT

A vent barrier system may include an insert and a cover. The insert may be dimensioned to be inserted within a flood vent duct through a first opening such that side faces of the insert contact sidewalls of the duct and thereby provide an insulative seal between the first opening and a second opening of the duct when inserted therein. The may be configured to be attached to the insert and be dimensioned to be selectively securable to vent at the first opening. The cover may be manipulatable to selectively remove the insert from the duct.

15 Claims, 11 Drawing Sheets

(56) References Cited

U.S. PATENT DOCUMENTS 2,633,100 A * 3/1953 Auerbach ..... A01K 39/0106 119/464
2,774,116 A 12/1956 Wolverton
2,798,422 A 7/1957 Bourque
2,834,278 A * 5/1958 Crute, Jr. ..... 454/276
3,123,867 A 3/1964 Combs
3,425,175 A 2/1969 Gerde
3,680,329 A 8/1972 Burtis
3,683,630 A 8/1972 Alexandre
3,866,681 A * 2/1975 Shirley ..... 166/285
3,927,709 A 12/1975 Anderson et al.
3,939,863 A 2/1976 Robison
3,942,328 A 3/1976 Bunger
3,974,654 A 8/1976 Mirto et al.
3,978,616 A 9/1976 Pennock
4,026,082 A * 5/1977 Crofoot ..... 52/302.7
4,048,771 A 9/1977 Thistlethwaite
4,116,213 A 9/1978 Kamezaki
4,146,346 A 3/1979 Salo
4,174,913 A 11/1979 Schliesser
4,186,215 A * 1/1980 Buchel ..... A23L 2/40 206/217
4,227,266 A 10/1980 Russell
4,231,412 A 11/1980 Nowak
4,290,635 A 9/1981 McKenzie
4,325,229 A * 4/1982 DeZurik ..... 62/262
4,349,296 A 9/1982 Langeman
4,378,043 A 3/1983 Sorenson
4,469,018 A * 9/1984 Taulman ..... 454/276
2,147,933 A 5/1985 Gb
4,549,837 A 10/1985 Herbert
4,559,367 A * 12/1985 Hurps ..... C08J 9/0061 264/45.3
4,576,512 A 3/1986 Combes et al.
4,606,672 A 8/1986 LeSire
4,669,371 A 6/1987 Sarazen, Jr. et al.
4,676,145 A 6/1987 Allred
4,699,045 A 10/1987 Hensley
4,754,696 A 7/1988 Sarazen et al.
4,958,654 A * 9/1990 Hoffman, Jr. ..... F16D 65/18 137/493.8
4,989,502 A * 2/1991 Ospelt ..... 454/275
5,050,895 A * 9/1991 Hashish et al. ..... 277/584
5,171,102 A 12/1992 De Wit
5,177,911 A * 1/1993 Ruemelin ..... B24C 9/00 451/456
5,253,804 A 10/1993 Sarazen et al.
5,293,820 A 3/1994 Vagedes
5,294,049 A 3/1994 Trunkle et al.
5,330,386 A 7/1994 Calandra
5,408,789 A 4/1995 Plfeger
5,425,739 A * 6/1995 Jessen ..... A61B 17/11 606/153
5,460,572 A 10/1995 Waltz et al.
5,487,701 A 1/1996 Schnedegger et al.
5,594,035 A * 1/1997 Walsh ..... C08J 11/08 521/147
5,660,466 A * 8/1997 Hopson ..... B01F 5/205 239/113
5,904,199 A 5/1999 Messner
5,944,445 A * 8/1999 Montgomery ..... E04B 1/7076 405/87
5,994,445 A 11/1999 Kaschel et al.
6,092,580 A 7/2000 Lucas
6,149,514 A * 11/2000 Maury ..... 454/276
6,165,066 A * 12/2000 Sharp et al. ..... 454/273
D438,300 S * 2/2001 Manger ..... D23/386
D441,858 S * 5/2001 Manger ..... D23/386
6,251,007 B1 * 6/2001 Smith ..... 454/292
6,287,050 B1 9/2001 Montgomery et al.
6,485,231 B2 11/2002 Montgomery et al.
6,692,187 B2 * 2/2004 Sprengle, Sr. ..... E02B 7/40 405/92
7,097,557 B2 * 8/2006 Kutschman ..... 454/276
7,556,560 B2 * 7/2009 Janesky ..... 454/276
7,600,944 B1 * 10/2009 Keating ..... 405/96
7,726,752 B2 * 6/2010 Lin et al. ..... 312/223.2
7,909,686 B2 * 3/2011 Achen ..... 454/283
7,926,770 B2 * 4/2011 Bonshor ..... 248/205.1
7,980,035 B1 * 7/2011 D'Apolito et al. ..... 52/302.1
8,230,650 B1 * 7/2012 Stamps ..... 52/198
8,308,396 B2 * 11/2012 Shook ..... 405/100
8,375,664 B2 * 2/2013 Gower et al. ..... 52/302.1
8,378,671 B1 * 2/2013 Mahoney ..... G01R 33/02 324/248
8,460,075 B2 * 6/2013 Mavroudis et al. ..... 454/275
8,511,938 B1 * 8/2013 Payne et al. ..... 405/93
9,004,814 B2 * 4/2015 Petrillo ..... 405/80
2003/0082008 A1 * 5/2003 Sprengle, Sr. ..... E02B 7/40 405/87
2006/0179719 A1 * 8/2006 Christie ..... E06B 7/32 49/169
2008/0236062 A1 * 10/2008 Bergaglio ..... F24F 13/084 52/169.5
2010/0040680 A1 * 2/2010 Lai ..... A61K 31/381 424/458
2010/0086358 A1 * 4/2010 Haryslak ..... E02D 31/02 405/87
2012/0028564 A1 * 2/2012 Kelly ..... E04B 1/7076 454/275
2012/0067574 A1 * 3/2012 Lopez ..... E21B 43/088 166/278
2012/0145620 A1 * 6/2012 Beard ..... B01D 37/025 210/205
2012/0266975 A1 * 10/2012 Kelly ..... E04B 1/7038 137/357
2013/0279986 A1 * 10/2013 Payne ..... E04B 1/70 405/98
2014/0109993 A1 4/2014 Kelly

OTHER PUBLICATIONS

Smart Vent, product literature "Smart Vent Foundation Flood Vents vs. Flood Flaps" printed Apr. 6, 2015.
Smart Vent, product literature "Family of Products" printed Apr. 6, 2015.
FEMA, Openings in Foundation Walls and Walls of Enclosures, Technical Bulletin 1, Aug. 2008.
FEMA, Non-Residential Floodproofing, Technical Bulletin 3, Apr. 1993.
Smart Vent, "Foundation Flood Vents" printed Apr. 6, 2015.
Smart Vent, Product Catalog printed Apr. 6, 2015.

* cited by examiner

FLOOD VENT BARRIER SYSTEMS

TECHNOLOGY

The present application generally relates to flood water control devices for enclosed areas, and more particularly, to flood water control devices for venting enclosed spaces within a foundation, garage, foyer, an entry, basement or other such area.

BACKGROUND

To help limit flooding damage, several building code organizations and the federal government have promulgated regulations that mandate that buildings with enclosed spaces located below base flood plain levels, such as crawl spaces, must provide for automatic equalization of interior and exterior hydrostatic forces caused by flooding fluids. According to these regulations, flooding fluids must be permitted to freely enter and exit the enclosed spaces. In particular, many of these regulations require builders to install a number of vents in the enclosed spaces. For example, U.S. Pat. No. 6,692,187, issued Feb. 17, 2004 to Sprengle, Sr., et al. for FLOOD GATE FOR DOOR, describes a flood gate configurations and various latching mechanisms for releasing a vent door, the disclosure of which is incorporated herein in its entirety.

SUMMARY

In one aspect, a vent barrier system comprises an insert comprising side faces extending between a first end and a second end of the insert. The insert may be dimensioned to be inserted within a flood vent duct through a first opening such that the side faces contact sidewalls of the duct and provide an insulative seal between the first opening and a second opening of the duct when inserted therein. A cover having a first side and a second side may be configured to be attached to the first face of the insert. The cover may be dimensioned to be selectively securable to vent at the first opening. The cover may be manipulatable to selectively remove the insert from the duct.

In further embodiments, the insert may be dimensioned to extend within the duct and prevent a door positioned at the second opening of the duct from opening when inserted therein. The insert may be dimensioned such that the second face locates adjacent to the door when inserted within the duct to prevent the door from moving from a closed position to an open position. The second side of the cover may be attached to the first face of the insert by an adhesive. A retention member may be configured for selectively securing the cover at the first opening of the duct. The retention member may comprise one of a latch and a bolt movable to secure and release the cover from the first opening of the duct. One of the vent, the cover, and the insert may include a retention slot positioned to receive the latch or bolt when moved to secure the cover at the first opening of the duct. The second side of the cover may include an outer perimeter surface configured to seal with a surface extending along an exterior perimeter of the first opening when the insert is inserted within the duct. One of the outer perimeter surface of the second side of the cover and the surface extending along the exterior perimeter of the first opening may comprise a gasket configured to compressingly seal with the adjacent surface when the cover is secured to the vent at the first opening. The cover may include a handle positioned at the first side of the cover configured to be gripped by a user to manipulate the cover. The system may further include a duct adaptor configured to adapt the vent to the dimensions of at least one of the cover and the insert. The duct adaptor may configured to be positioned within the duct and form at least a portion of the sidewalls of the duct such that the sidewalls sealing engage the side faces of insert for a tight fit when the insert is inserted within the duct. The duct adaptor may include a flange configured to be positioned along an exterior perimeter of the first opening. The flange may comprises a surface configured to engage the second face of the cover and form a seal therebetween when the cover is secured to the vent at the first opening. The duct adaptor may further includes a recess dimensioned to receive the cover. The recess may include a base comprising the flange.

In another aspect, a flood vent barrier may comprise an insert comprising side faces extending between a first end and a second end of the insert, wherein the insert is dimensioned to be inserted within a flood vent duct through a first opening such that the side faces contact sidewalls of the duct and provide an insulative seal between the first opening and a second opening of the duct when inserted therein. The insert may comprise a flood modifiable configured to be modified when contacted by water such that the modification removes the insulative seal provided by the insert to allow water to flow through the duct between the first opening and the second opening.

The fluid modifiable material may be configured to deteriorate when contacted by water such that a dimension of the insert reduces to allow the insert to be dislodged from the vent by water flowing into the duct through at least one of the first opening and the second opening. The fluid modifiable material may be configured to dissolve when contacted by water.

In yet another aspect, a sealing kit for providing a substantially air tight seal between a first opening and a second opening of a flood vent duct comprises a duct adaptor dimensioned to be positioned at the first opening. The duct adaptor may include sidewalls defining an interior perimeter of the duct and extending from a first end positioned at the first opening to a second end positioned toward the second opening of the duct, an abutment extending interiorly from the second end of at least one sidewall. The sidewalls and abutment define a compartment dimensioned to receive an insert therein. The kit further comprises a cover defining a rim configured to selectively secured at the first end of the duct adaptor to retain the insert when the insert is positioned within the compartment. The insert provides a substantially air tight seal between the first end of the duct adaptor and the second opening of the duct when the insert is retained within the compartment.

The sealing kit may further comprise a retainer mechanism configured to selectively secure the cover at the first end of the duct adaptor. The retainer mechanism may comprise a retention feature comprising one of an extendable bolt, a latch, and a slot configured to receive a retention member. The sealing kit may further comprise the insert, wherein the insert comprises a fluid modifiable material configured to one of deteriorate and dissolve when contacted by water present at one of the first end and the second end of the duct adaptor to remove the substantially airtight seal.

BRIEF DESCRIPTION OF THE DRAWINGS

The various features and advantages of the inventive arrangements and the manner of attaining them will become more apparent and the disclosure itself will be better understood by reference to the following description of embodiments taken in conjunction with the accompanying drawings, it being understood, however, the inventive arrangements are not limited to the precise arrangements and instrumentalities shown, wherein.

DESCRIPTION

Figure 1:
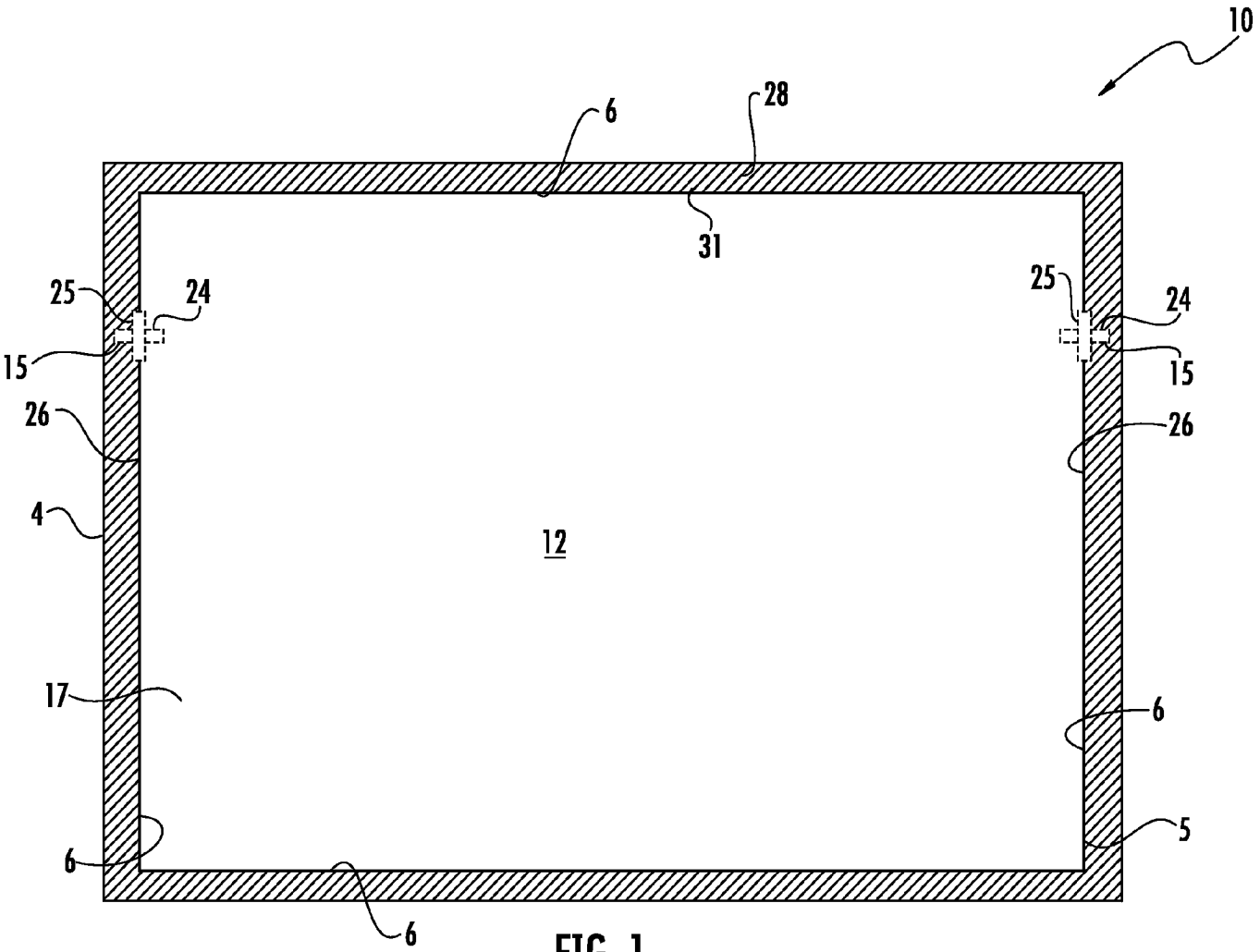
FIG. 1 illustrates a vent including a door positioned within a duct according to various embodiments.
Figure 2:
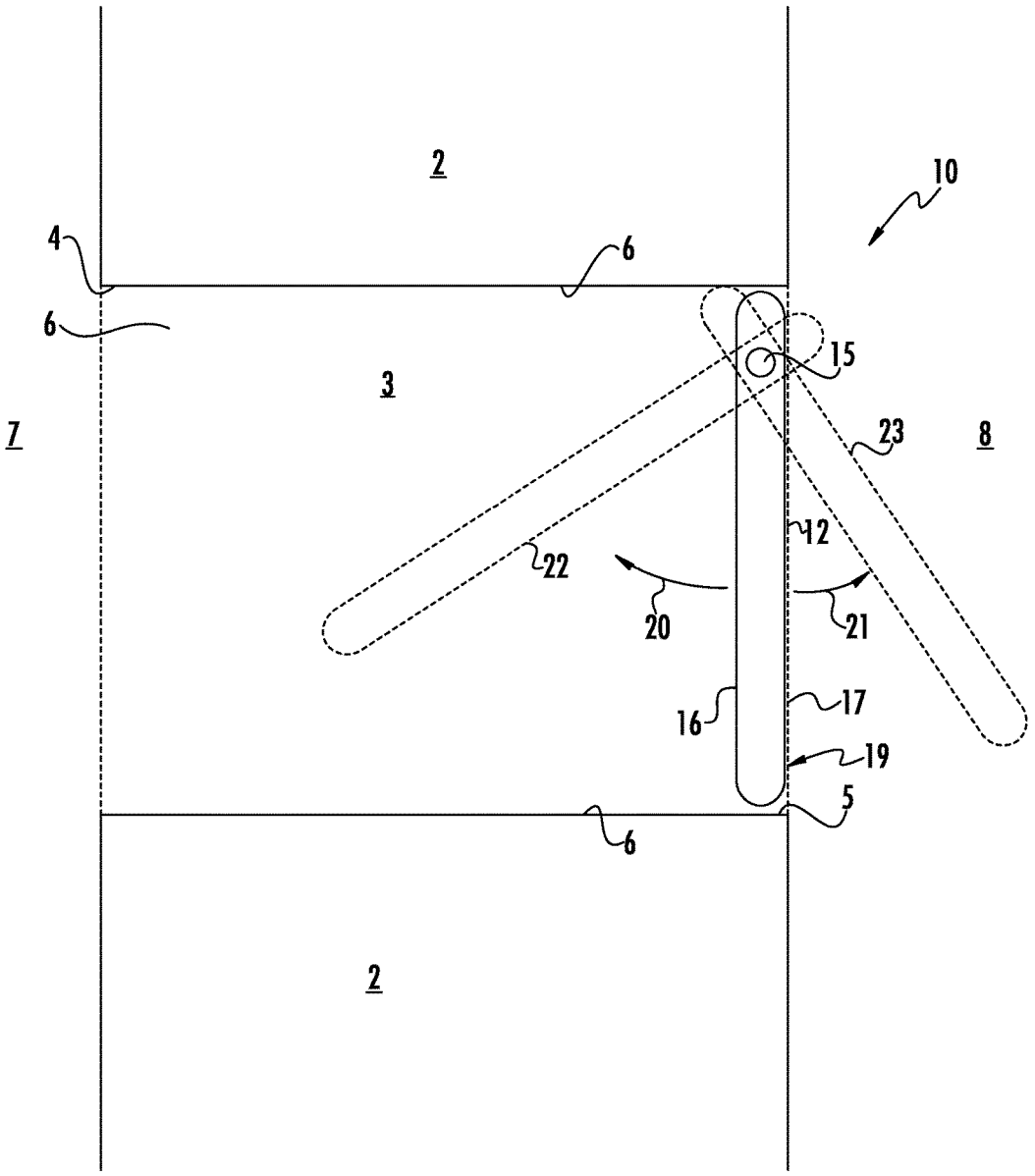
FIG. 2 illustrates a cross-sectional view of the vent shown in FIG. 1 according to various embodiments.

FIGS. 1 & 2 illustrate an arrangement of a flood vent 10 according to various embodiments. The vent 10 may be associated with a structure 2 such as a wall or portion of a building, a foundation, a basement, a garage, a foyer, an entry, or a structure located below base flood plain levels configured to provide an entry or exit passage for fluid. The vent 10 generally comprises a duct 3 extending through the structure 2 between a first opening 4 and a second opening 5. In general, the vent 10 further comprises various components locatable or positioned, e.g., inserted, defined, or installed within or around the duct 3.

In some embodiments, the vent 10 may be configured or dimensioned to comply with various building code and federal government regulations that mandate that buildings with enclosed spaces located below base flood plain levels, such as crawl spaces, must provide for automatic equalization of interior and exterior hydrostatic forces caused by flooding fluids. According to these regulations, flooding fluids must be permitted to enter and exit the enclosed spaces freely using flood venting. Accordingly, the duct 3 may be designed for location with respect to the structure 2 to provide an entry point or exit point for flooding fluids, such as water, and debris within the flooding fluids between first and second environments 7, 8 separated by the structure 2. The vent 10 may thus be configured to provide equalization of interior and exterior hydrostatic forces caused by the flooding fluids.

The vent illustrated in FIGS. 1 and 2 includes a door 12 configured to be positioned within the duct 3 to control or modulate access to the duct 3, however, in some embodiments, the vent 10 may not include a door 12. The door 12 may generally comprise a separation device configured to separate the first environment 7 and second environment 8 when the door 12 is in a closed position, as show in FIGS. 1 & 2. In at least one embodiment, the door 12 may be configured to provide a seal between the first environment 7 and the second environment 8. In some embodiments, however, the door 12 may not provide such a seal. It will be appreciated that the first environment 7 or second environment 8 may include an interior portion of the duct 3 depending on the particular configuration. For example, the door 12 may be positioned within the duct 3 such that the door 12 separates a portion of the duct 3 located adjacent to a first face 16 of the door 12, which may include an interior portion of the duct 3, and a portion of the duct 3 adjacent to a second face 17 of the door 12, which may also include an interior portion of the duct 3. As shown, the door 12 is positioned at the second opening 5 of the duct 3 to separate the first environment 7, which in this configuration includes an interior portion of the duct 3 and the second environment 8. Depending on the desired application, the door 12 may also be more interiorly positioned within the duct 3 between the first and second openings 4, 5. The environments 7, 8 or portions thereof external to the duct 3 may include an interior of a building, foundation, or other structure, such as an enclosed area such as a room, crawl space, or enclosed portion of a foundation. External environments may also include the exterior to a building, foundation, or other structure, which may be prone to flooding. Thus, the door 12 may be positioned within a duct 3 that extends between an interior and exterior of a wall.

The duct 3 is defined by sidewalls 6 extending along an inner perimeter of the duct. The sidewalls 6 may be formed by or defined in the structure 2. All or a portion of the sidewalls 6 may also include a sleeve lining extending therealong. The sleeve may include any suitable material. In some embodiments, for example, a sleeve comprises wood, a metallic, plastic, rubber, polymer, or a rigid material. Such materials may further be configured to be non-corrosive and optionally include such a coating. In one embodiment, the vent 10 includes sidewalls 6 including a sheet metal sleeve that lines the interior perimeter of the duct 3. The cross-section of the illustrated duct 3 comprises a rectangular shape defined by the sidewalls 6 however other cross-sections may be used, e.g., geometric, regular, or irregular, polygonal, square, circular, oval, or arcuate.

In various embodiments, the door 12 may comprise a corrosion-resistant material, such as a suitable stainless steel, plastic, or polymer. The door may also be positioned within a frame locatable along the duct 3, which may also be formed of a rigid corrosion resistant material, such as stainless steel, a plastic, or polymer, for example. The frame or duct 3 is not limited as to a particular dimensioning; however, in one arrangement, the door 12 may be positioned within an 8 inch by 16 inch frame. The sidewalls 6 may similarly define a perimeter of approximately 8 inch by 16 inch or other dimensions, e.g., the perimeter may be oversized with respect to the particular dimensions of the door 12. For example, the frame may allow an undersized door 12 to be fitted in the duct 3. The frame may also be configured for multiple doors 12 to be stacked within the duct 3 in multiple rows or columns. All or a portion of the sidewalls 6 may be referred to as a frame configured to receive a door 12 or an insert, as explained in more detail below, and which may further include sidewalls 6 defined by a liner.

The door 12 may be attached to the duct 3, e.g., at the sidewalls 6 or a frame located along the duct 3, such that the door 12 may pivot relative to duct 3 from a closed position 19 in one or both of a first direction 20 and a second direction 21. For example, the door 12 may pivot in a first direction 20 between the closed position 19 and a first open position 22, see FIG. 2, shown in ghost, or in the second direction 22 between the closed position 19 and a second open position 23, see FIG. 2, also shown in ghost. It will be appreciated that, in various embodiments, the first and second open positions 22, 23 may include greater or lesser pivots in the first and second directions 20, 21.

Many features capable of pivoting the door 12 are well known in the art and may be suitably incorporated into various embodiments to pivot the door 12. As shown, the door 12 may be configured to pivot about a pivot 15 that may pivotably couple the door 12 to sidewalls 6 via pins 24 pivotably received within slots 25. The pins 24 may extend between side faces 26 of the door 12 and sidewalls 6 of the duct 3. In one embodiment, the pins 24 may be attached to the side faces 26 of the door 12 and be adapted to be received within slots 25 defined in the sidewalls 6, however, other configurations may be used. For example, in another embodiment, the pins 24 may be attached to the sidewalls 6 and be adapted to be received within slots 25 defined in the side faces 26 of the door 12. Various pivot positions 15 may be used. As shown, the pivot 15 is positioned along an upper portion of the door 12, however, in other embodiments, the pivot 15 may be located along a middle or lower portion of the door 12. The door 12 may also comprise one or more louvers or multiple stacked doors 12 configured to rotate independently or together about the pivots 15. Thus, the door 12 may be configured to open in one or both directions 20, 21. For example, the pivot 15 may include a stopper configured to prevent pivoting of the door 12 in the first direction 20 or second direction 21 or an extent thereof. For example, the stopper may include an engagement surface or notch positioned or defined on the pin 24 or pivot 15 configured to engage another stopper comprising an engagement surface to prevent the door 12 from pivoting beyond at predetermined position between the closed position and an open position. The pivot 15 may also be biased to limit or assist pivot movements of the door 12 in the first or second directions 20, 21 or between open and closed positions. Various door configurations are described in U.S. Pat. No. 6,287,050, issued Sep. 11, 2001 to Montgomery et al. for FOUNDATION FLOOD GATE WITH VENTILATION, and U.S. Pat. No. 6,692,187, issued Feb. 17, 2004 to Sprengle, Sr., et al. for FLOOD GATE FOR DOOR, the disclosures of which are incorporated herein in their entirety.

As shown in FIG. 1, a gasket or strip 28 may be positioned between or along the interfacing portions of the door 12 and sidewalls 6 to provide additional insulation or a seal. The strip 28 may be positioned along the upper, lower, or sidewalls 6 or upper, lower, or side faces 26 of the door 12, or both, and may include insulation materials or materials dimensioned to seal the interfaces such as rubber, plastics, foam, polymers, insulative materials, etc. In one embodiment, the strip 28 comprises a rubber flap configured to engage the adjacent surface of the interface to provide an improved seal between the first and second sides 16, 17 of the door 12. In one embodiment, the strip 28 may extend between the sidewalls 6 and the upper, lower, or side faces 26 of the door 12 such that the first or second face 16, 17 of the door 12 may rest against the strip 28. For example, the vent 10 may be configured such that the first or second face 16, 17 of the door 12 is compressed against the strip 28 when the door 12 is in the closed position. In some embodiments, as described in more detail below, an insert may be used in addition to or instead of the strip 28 to provide insulation or a seal between the first and second opening 4, 5 or environments 7, 8.

Vents 10 may be installed in various configurations. For example, vents 10 may be installed independently, or in a stacked, modular formation within a structure 2 such as a wall forming a portion of a house or other structure or in an overhead garage door, for example. Such multi-vent formations may be desirable in flood prone areas where the number of vents 10 required for proper ventilation would make the foundation structurally unsound if the vents 10 were placed side by side. Multi-vent configurations may also be desirable when a foundation is not formed from concrete block but rather formed from poured concrete where it may be more desirable to make holes of larger size but fewer in number than numerous openings having small sizes. In this configuration, each vent 10 may or may not act independently of each other. For example, in at least one embodiment, opening of a single vent 10 may similarly trigger the opening of additional vents 10.

As described above, a flood vent 10 includes a duct 3 extending through a structure 2, such as a wall, foundation, etc., positioned between two environments 7, 8 to allow flood waters or other fluids to pass therebetween when appropriate. In some applications, it may be beneficial to provide a barrier between the two environments 7, 8 to obstruct fluid flow through the duct 3 when it is undesirable to operate the vent 10 as a fluid path. Accordingly, in various embodiments, a vent 10 includes a vent barrier system including a selectively insertable or removable barrier wherein the barrier may be removed therefrom by one or both of the user and a flood condition.

Figure 3:
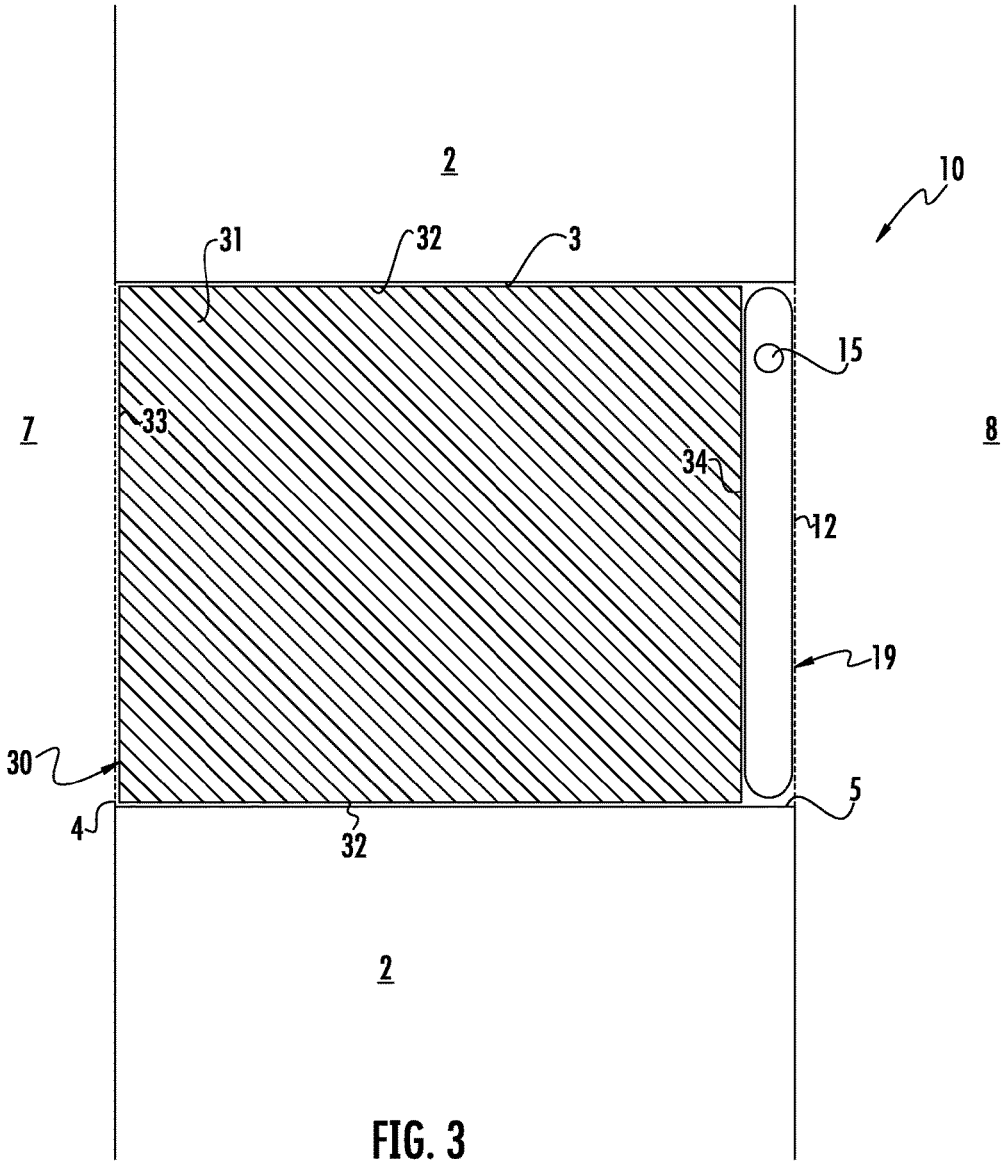
FIG. 3 illustrates a cross-sectional view of the vent shown in FIGS. 1 & 2 including an insert of a vent barrier system positioned within the duct according to various embodiments.

Barriers systems are preferably configured to provide insulation, such as a relatively airtight seal, from weather as well as provide security from unwanted intrusions between the environments 7, 8. FIG. 3 illustrates a vent 10 comprising a vent barrier system 30 according to various embodiments. Barriers configured for the vent barrier system may generally include an insert 31 or insert portion configured to be inserted within the duct 3. In some embodiments, the insert 31 operates as an additional or secondary obstruction or in conjunction with the door 12, however, in other embodiments, the vent 10 may not include a door 12 and the insert 31 may comprise the only or primary obstruction. For example, in some structures, it may be acceptable by code to seal a duct without a door 12 with a vent barrier system 30 comprising an insert 31 when the seal provided by the insert 31 obstruction is removable. Upon warning of a flood, for instance, the insert 31 and hence the seal may be removed from the duct 3 to allow fluids such as flood waters to pass therethrough to relieve hydrostatic pressure.

The insert 31 comprises side faces 32 extending between first and second ends each comprising a respective end face 33, 34 and is dimensioned to be removably inserted into the duct 3. The insert 31 may include complementary dimensions to that of the duct 3 such that the insert 31 may occupy the duct 3 when inserted therein to obstruct passage of fluid through the duct unless removed or modified as described in more detail below. For example, the insert 31 may be formed of one or more materials suitable to provide an insulative barrier or seal between the first and second environments 7, 8, e.g., a thermal insulating material such as a insulative foam, polymer, cellulose, fiberglass or other fibrous material, recycled materials, composite, etc.

The insert 31 may be dimensioned to be complementary to the duct 3, which in some instances may include outer dimensions greater than the corresponding dimensions of the duct 3 such that, when inserted, the side faces 32 compress against the interfacing sidewalls 6 to create a seal. In one embodiment, the side faces 32 of the insert 31 may be textured or ribbed to provide an improved seal or insulation. In one embodiment, all or a portion of the insert 31 comprises a compressible or elastic material. The material may line one or more of the side faces 32 of the insert 31 and the outer dimensions of the insert 31 may define a greater cross-section than the corresponding cross-sectional dimensions of the duct 3 such that, when inserted, the material is in a compressed or deformed state and recovery results in a reversing force applied outward of the duct 3 or toward the sidewalls 6 to enhance a seal. In another embodiment, the interior of the insert 31 includes a compressible material and the side faces 32 include an elastic or compressible material.

Figure 4A:
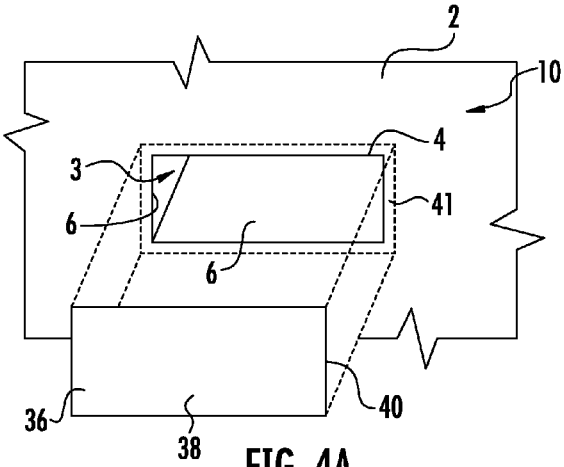
FIG. 4A illustrates a cover for a vent barrier system according to various embodiments.

FIG. 4A illustrates an embodiment of a cover 36, which may be a component of a vent barrier system 30 according to various embodiments. The cover has a first side 38 and a second side 39 and is dimensioned to be posited over the first opening 4 of the duct 3 thereby providing additional insulation, security, convenience, or to retain the insert 31 within the duct 3. The cover 36 may define various cross-sections and, in some embodiments, a cross-section of the cover 36 may be the same or greater than a cross-section of the duct 3 or opening 4. The cover 36 may entirely cover the opening 4, as shown. However, in some embodiments, the cover 36 may not entirely cover the opening 4 or insert 31. For example, the cover 36 may provide retention features such as attachment devices configured to assist in retaining the insert 31. The cover 36 may also be configured to provide additional insulation or seal where needed. The shape or profile of the cover 36 may match that of the opening 4. In some embodiments, however, the shape or profile of the cover 36 may be different than the opening. For example, the opening 4 may have a rectangular shape or profile and the cover 36 may be shaped to have a different profile such as an oval or other regular or irregular geometric shape. As shown, the cover 36 has a generally rectangular profile comprising oversized cross-sectional dimensions with respect to the opening 4 of the duct 3.

The cover 36 may also define an oversized cross-section with respect to the cross-sections defined by the insert 31 and the duct 3 in at least one dimension. For example, as shown, the cover 36 includes oversized vertical and horizontal dimensions forming an outer flange 40 along the second side 39, see FIG. 4B, for interfacing with a surface 41 (broken line outline) positioned around the perimeter of the duct 3.

Figure 4B:
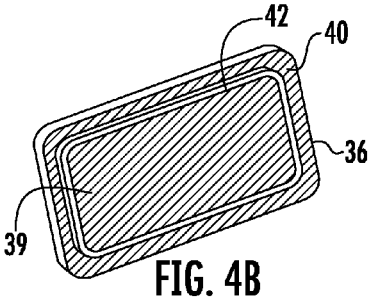
FIG. 4B illustrates the interior facing face of the cover illustrated in FIG. 4A according to various embodiments.

FIG. 4B illustrates the second side 39 or duct facing side of the cover 36 which may include gasket 42 comprising an insulation or sealing strip or layer configured to insulate or seal when interfaced with the surface 41 around the duct 3. The gasket 42 may typically be positioned along the flange 40 portion of the cover 36 such that when the cover 36 is secured to the duct 3, a seal may be formed between the flange 40 and the surface 41 around the duct 3. In some embodiments, the surface 41 around the duct 3 may include a gasket or insulation strip in addition to or instead of the gasket 42 positioned around the flange 40.

Figure 4C:
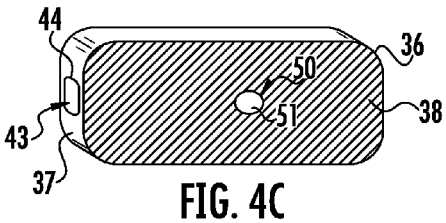
FIG. 4C illustrates a further embodiment of the cover including a handle and retention features.

The cover 36 may be secured to the surface 41 to retain the insert 31 in the duct 3. The cover 36 is preferably removably secured such that the cover 36 may be selectively removed to allow removal of the insert 31 upon warning of a flood or as otherwise desired. The cover 36 may include attachment devices such as clips, snaps, posts, grooves, latches or slots for securing the cover 36 to the duct 3 or a frame within duct 3. FIG. 4C illustrates a further embodiment of the cover 36 wherein the cover 36 comprises a retention feature 43 comprising a retention slot 44 defined at a side face 37 of the cover 36 for receiving another retention feature 43 such as an extendable bolt or tab 45, as shown in FIG. 5C for example. In some embodiments, the cover 36 may include slots for screws or compressible clips for to secure the cover 36 to the surface 41, however, other manners of attachment may be used, e.g., magnets, Velcro, latches, clips, compression fitments, etc. Similarly, in some embodiments, the cover 36 may comprise an extendable member such as a bolt or tab that may be selectively extendable into or retractable from a retention slot associated with the duct 3 or structure 2 or may be biased for extension into or retraction from the retention slot. In some embodiments, the duct 3 may include a duct adaptor comprising a sleeve that extends along and forms at least a portion of the sidewalls 6 of the duct 3. The adaptor may include a flange configured to extend from the duct opening 4 and form at least a portion of the surface 41. As explained in more detail below, the adaptor may be configured to adapt the duct 3 to a particular cover or insert configuration.

The cover 36 may also include a handle 50 positioned on the first side 38 of the cover 36. The handle 50 may include one or more grip features that may be gripped by a user to allow a user to easily manipulate the cover 36 by gripping the handle. The grip feature illustrated in FIG. 4C includes a knob 51 extending from the first side 38 of the cover 36 however other extensions comprising features suitable for gripping may be used. In some embodiments, the handle 50 may include one or more recessed grip features to allow a user to insert a hand or portion thereof to manipulate the cover 36.

Figure 4D:
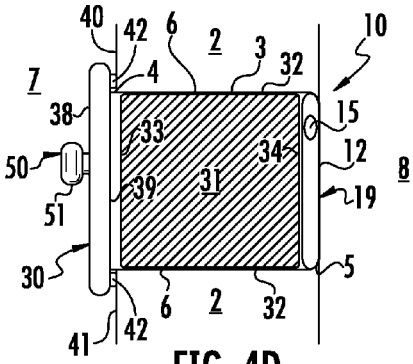
FIG. 4D illustrates a cross-sectional view of a vent barrier system comprising an insert and the cover shown in FIG. 4C according to various embodiments.

FIG. 4D illustrates the cover 36 positioned over the first opening 4 of the duct 3 wherein the insert 31 is positioned within the duct 3. The insert 31 is positioned to prevent the door 12 from moving to the first open position 22 in the first direction 20, see FIG. 2. Depending on the configuration, the insert 31 may similarly be positioned to obstruct the door 12 from moving to the second open position 23 in the second direction 21. Accordingly, a vent barrier system 30 may comprise an insert 31 and cover 36 wherein, when the insert 31 and cove r are positioned with respect to the duct 3 and opening 4, the system 30 provides insulation and security during times the vent is not intended to provide a fluid path between the two environments 7, 8 separated by the structure 2. In some embodiments, the insert 31 may be configured such that it does not obstruct the movement of the door 12 when inserted. In such instances, a separate mechanism may be used to manipulate the movement of the door 12.

Figure 5A:
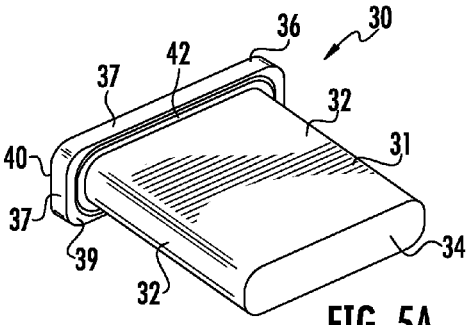
FIG. 5A illustrates a cover and insert combination of a vent barrier system according to various embodiments.

FIG. 5A illustrates a further embodiment of a cover 36 and insert 31 of a vent barrier system 30 wherein the cover 36 is attached to the insert 31. As shown, the cover 36 is attached to the first end face 33 of the insert 31. While the cover 36 may generally be attachable to the insert 31 using any known manner, in one exemplary embodiment, the insert 31 may be attached to the cover 36 with an adhesive. Other manners of attaching the cover 36 to the insert 31 may include a compression fitment or attachment members configured to extend into the insert 31 to engage the insert 31 material or one or more pre-defined grooves or slots therein.

Figure 5B:
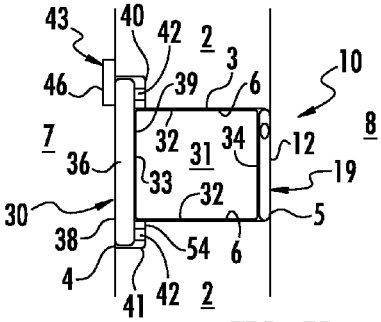
FIG. 5B illustrates a cross-sectional view of a vent including a vent barrier system including an insert and the cover shown in FIG. 5A according to various embodiments.
Figure 5C:
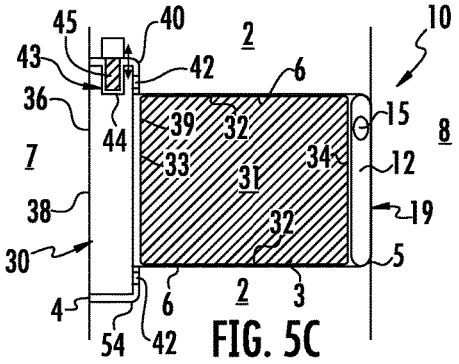
FIG. 5C illustrates a cross-sectional view of a vent including a vent barrier system comprising an insert and an alternate configuration of the cover shown in FIG. 5A according to various embodiments.

FIG. 5B illustrates the cover 36 and insert 31 of FIG. 5A positioned within a duct 3 wherein the first opening 4 includes a recessed fitting 54 for receiving and interfacing with the outer perimeter or flange 40 of the second side 39 of the cover 36. Such a configuration may be provided by a duct adaptor or by forming the recessed fitting 54 in the structure 2. In a further embodiment, the recessed fitting 54 may include a gasket forming a liner of insulation or sealing strip positioned within the recessed fitting 54 to seal the interface when the cover 36 is positioned therein. The gasket may be in addition to or instead of the gasket 42 positioned along the second side 39 of the cover 36. A retention feature 43 comprising a pivotable latch 46 may be used to retain the cover 36 at the opening 4. Other retention features 43 may also be used, such as a bracket, slot, clip, screw, bolt, tab or as otherwise described herein. The retention feature 43 will generally operate in cooperation with another retention feature 43 associated with the duct 3 or structure 2.

FIG. 5C illustrates another embodiment of the cover 36 and insert 31 of FIG. 5A wherein the retention feature 43 is positioned at a side face of the cover 36. The retention feature 43 may be any suitable retention feature 43 such as a latch, bracket, slot, clip, screw, bolt, tab, for example, to retain the cover 36 at the first opening 4. As shown, the retention feature 43 comprises a retention slot 44. The vent 10 further comprises a retention feature 43 comprising an extendable tab or bolt 45. The bolt 45 may be biased or extendable into the retention slot 43 to retain the cover 36 and retractable from the retention slot 43 to release the cover 36. It is to be understood that the retention feature 43 may be associated with multiple or different sides or faces or portions of the cover 36, however, for brevity, retention features 43 are generally shown at only a single location. It is also to be appreciated that the recessed fitting 41 may be suitably configured for any the herein described embodiments.

Figure 6A:
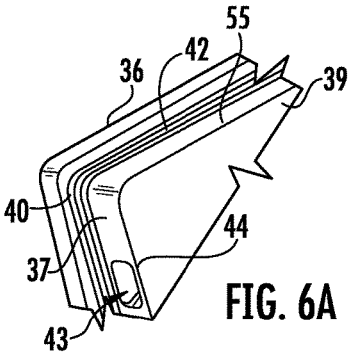
FIG. 6A illustrates a cover of a vent barrier system according to various embodiments.
Figure 6B:
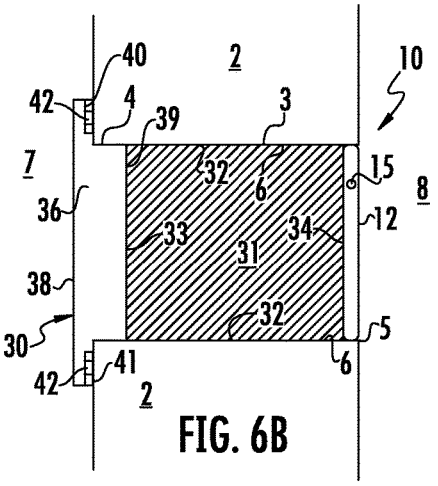
FIG. 6B illustrates a cross-sectional view of a vent including a vent barrier system including the cover shown in FIG. 6A secured to an insert according to various embodiments.

FIG. 6A illustrates a configuration of a cover 36 having a fitting 55 formed at its second side 39. The fitting 55 is dimensioned to have an undersized cross-section relative to the flange 40 and therefore define a flange 40 along the perimeter of the second side 39. The fitting 55 may be dimensioned such that it may be received within the duct 3 at the first opening 4. For example, the fitting 55 may be generally complementary in dimension with that of the opening 4. The cover 36 may include a retention feature 43 such as a retention slot 44. In a further embodiments, other retention features 43 may be used. For example, the retention feature 43 may be an extendable bolt or tab that may be biased or extendable outward of the fitting 55 toward the sidewalls 6 of the duct 3. In the illustrated embodiment, the retention feature 43 is positioned interiorly with respect to the flange 40 as well as the gasket 42, however, other configurations may be used. For example, as shown in FIG. 6B, the flange portion of the cover 36 may comprise or house a retention feature 43 or mechanism. In one embodiment, the cover 36 may be configured to abut or obstruct removal of the insert 31 within the duct 3 without attaching the insert 31 to the cover 36, e.g., as shown in FIG. 4D, in other embodiments however the insert 31 may be secured to the fitting 55 in any suitable manner, such as via adhesives or attachment members. In another embodiment, not shown but similar to the configuration of FIG. 5C, a retention feature may be positioned or be positionable at the first face of the cover 36 to retain the cover 36 at the first opening 4.

Figure 7A:
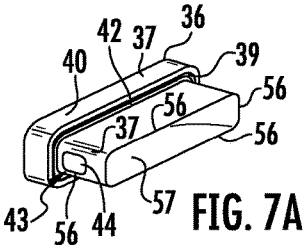
FIG. 7A illustrates a cover of a vent barrier system according to various embodiments.
Figure 7B:
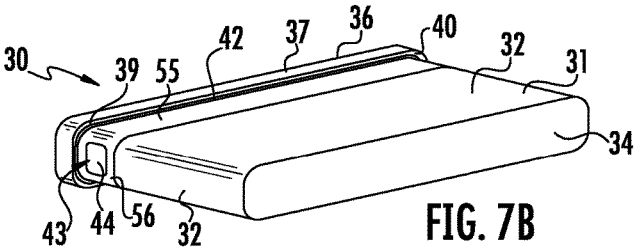
FIG. 7B illustrates a an insert secured to the cover shown in FIG. 7A according to various embodiments.

FIGS. 7A & 7B illustrate a cover 36 and insert 31 configuration according to various embodiments. The cover 36 includes walls 56 extending from its second side 39 defining a slot 57, as best seen in FIG. 7A, for receiving the insert 31, shown inserted in FIG. 7B. The insert 31 may be secured to the second side 39 of the cover 36 or along inward facing portions of the walls 56, e.g., via compression fitment, adhesives, or attachment members extending through or from one or more of the walls 56 defining the slot 57 and onto the side faces 32 of the insert 31. One or more retention features 43 may be defined in or incorporated in the walls 56. As shown, the retention feature 43 include a retention slot 44 defined the wall 56 defining the slot 57 however other suitable retention features 43, such as those described herein, may be used. The retention slot 44 may be configured to cooperatively interact with another retention feature 43 associated with the vent 10 such as a bolt or tab that is inwardly biased or extendable from the sidewalls 6 of the duct 3 into the retention slot 44 to retain the cover 36 at the first opening 4. The retention tab or bolt is preferably configured to also be retractable toward the sidewalls 6 of the duct 3 to retract the tab or bolt from the retention slot 44 when it is desirable to remove the obstruction.

FIGS. 8A-8E illustrate various configurations of exemplary retention mechanisms 47 comprising retention features 43 configured to retain the cover 36 or insert 31 at the opening 4. It is to be appreciated that the cover 36, insert 31, or duct 3, which may include an inner or outer duct surface, sleeve, or adaptor thereof may be configured to include such features. As such, the retention features 43 are shown cooperatively coupling to retain first and second barrier system components 52, 53, either of which may be the insert 31, cover 36, duct 3, sleeve, or adaptor thereof. It is also to be understood that, in various embodiments, covers 36 may be positioned at both openings 4, 5 of a duct 3.

Figure 8C:
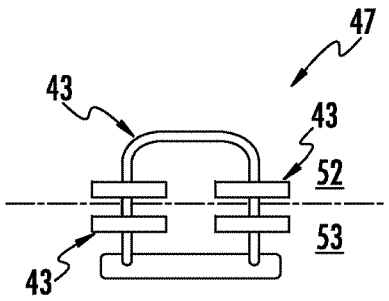
FIGS. 8A-8F illustrate vent barrier system retention mechanisms according to various embodiments.
Figure 8F:
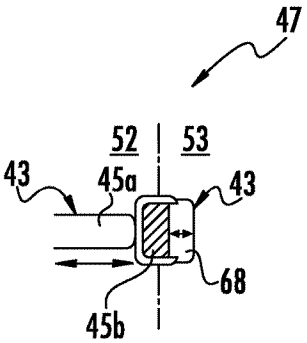
Figure 8B:
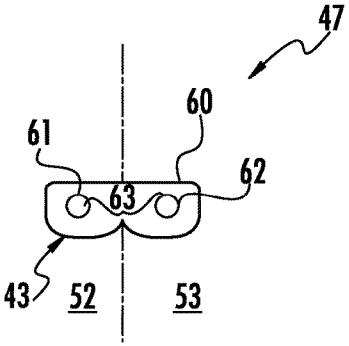
Figure 8E:
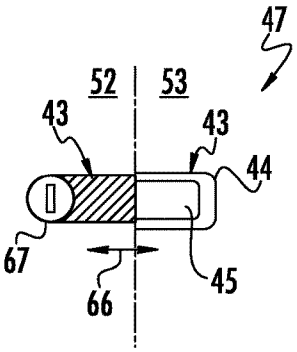
Figure 8A:
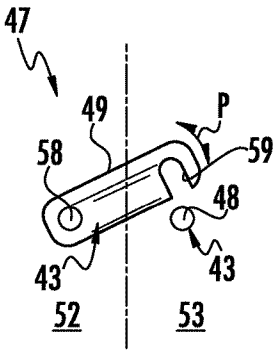

FIG. 8A illustrates a retention mechanism 47 comprising a latch. The latch includes retention features 43 comprising a post 48 and a latch arm 49 that is rotatable about a pivot pin 58 as indicated by arrow P. The latch arm 49 defines a slot 59 having an open end to receive the post 48 therein. The latch arm 49 may be pivoted to receive the post within the slot 59 to lock the cover in position. Other latch configurations may also include latch arms 49 comprising a hook configured to be received within a retention slot.

FIG. 8B illustrates a retention mechanism 47 comprising a brace. The brace includes retention features 43 comprising a bracket 60 having slots 61, 62, each for receiving an attachment member 63, such as a bolt, pin or screw. The first and second barrier components 52, 53 define additional retention features 43 comprising retention slots, not visible, positioned to align with the slots 61, 62 of the bracket 60 such that the attachment members 63 may be inserted through the aligned slots to retain the cover at the opening. The attachment members 63 may comprise screws that may be threaded into the slots defined in the cover and a surface defining the opening 4. In at least one embodiment, the attachment members 63 comprise tamperproof locking security screws to prevent unauthorized removal.

FIG. 8C illustrates another embodiment of a retention mechanism 47 comprising retention features 43 configured to retain the cover at the opening. The retention features 43 include retention slots 44 extending from the first and second barrier components 52, 53. The slots 44 are positioned such that when the cover is positioned at the opening, the slots 44 align to receive a bolt 45 and couple the first and second barrier components 52, 53. In some configurations, the bolt 45 may thread through the slots 44 to limit tampering and increase security. Certain configurations may also include locking features, e.g., the bolt 45 may be prevented from removal from the slots 44 unless the user has a key, code, or specifically configured removal device. As shown the bolt 45 comprises a "U" bolt configured pad or bar lock.

Figure 8D:
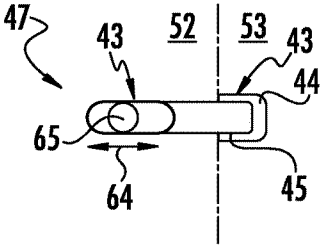

FIG. 8D illustrates another embodiment of a retention mechanism 47 comprising retention features 43 configured to retain the cover at the opening. The retention features 43 include an extendable bolt 45 and a retention slot 44. The bolt 45 may be slideably extendable and retractable as indicated by arrow 64 via a handle 65 to be received within the retention slot 44 and retracted from the retention slot 44.

FIG. 8E illustrates another embodiment of a retention mechanism 47 comprising retention features 43 configured to retain the cover at the opening. The retention features 43 include an extendable bolt 45 and a retention slot 45. The bolt 45 may be extendable or retractable as indicated by arrow 66 via a secured access port 67 to be received within the retention slot 44 and retracted from the retention slot 44. As shown, the secured access port 67 requires a key to retract or extend the bolt 45. For example, the bolt 45 may be biased toward the retention slot 44 and the secured access port 67 may be operable to retract the bolt 45 from the retention slot.

FIG. 8F illustrates an embodiment of a retention mechanism 47 comprising retention features 43 configured to retain the cover at the opening. The retention features 43 include an extendable bolt 45*a* and an extendable tab 45*b*. The extendable bolt 45*a* may be extended by any suitable mechanism, such as those described above. As shown, the second barrier component 53 includes the tab 45*b* allowing location of the cover into the opening of the duct, but limiting its removal. For example, the tab 45*b* may be received within a compartment 68 of the second barrier component 53 during insertion or positioning of the cover and be biased toward the first barrier component 52 such that the tab extends within a retention slot 44 within the first barrier component 52 when properly positioned at the opening. Once the tab 45*b* is located within the slot 44, abutting surfaces of the tab 45*b* and slot 44 may prevent removal of the cover. To remove the cover, the extendable bolt 45*a* may be extended toward the tab 45*b* to overcome the bias and expel the tab from the slot 44 and reposition the tab 45*b* within the compartment 68, thereby allowing the cover to be removed from the duct. In another configuration, not shown, the first barrier component 52 does not include an extendable bolt 45*a* configured to expel the tab 45*b* from the slot 44, rather, the second barrier component 53 is configured to selectively retract the tab 45*b* into the compartment 68. The second barrier component 53 may include, for example, a movable arm or latch coupled to the tab 45*b* that may be manipulated to retract the tab 45*b*. In one embodiment, the movable arm or latch may include a slide member that may be slid by the user, which may be similar to the slide function shown in FIG. 8D. In another embodiment, the movable arm or latch may include a secured access port configured to move the arm or latch to lock or retract the tab 45*b* into the compartment 68 when manipulated with a security key, which may be similar to the secured access port of FIG. 8E.

Figure 9:
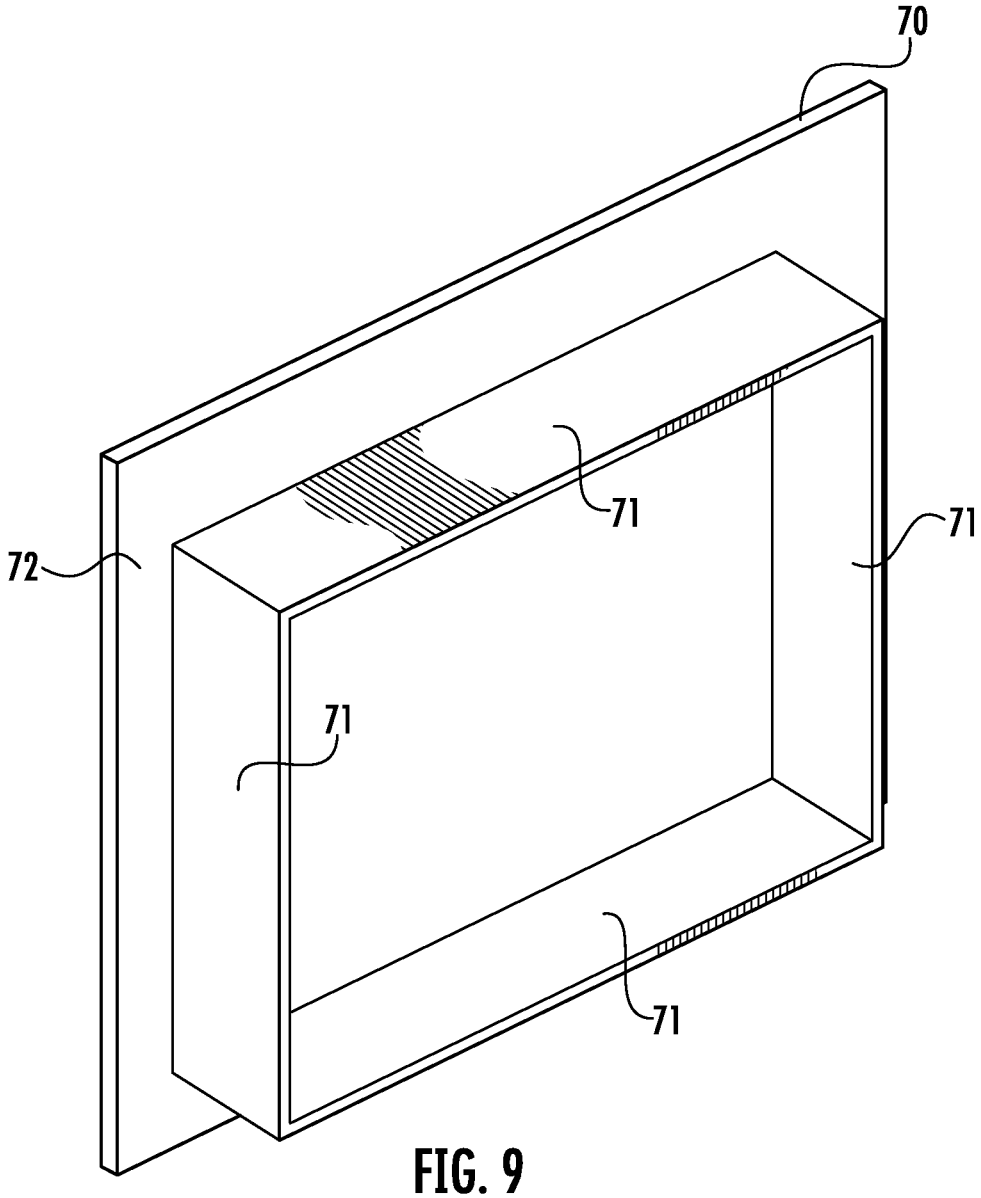
FIG. 9 illustrates a duct adaptor of a vent barrier system according to various embodiments.

In various embodiments, a vent barrier system may comprise a duct adaptor configured to provide fitment for an insert or cover. FIG. 9 illustrates a duct adaptor 70 according to one embodiment. The duct adaptor 70 includes a sleeve portion having sidewalls 71 configured to line an interior surface of the duct to thereby form sidewalls of the duct. The duct adaptor 70 further includes a flange 72 dimensioned to extend along the perimeter surface defining the duct opening, such as surface 41 shown in FIGS. 4A & 5B. In various embodiments, the duct adaptor 70 may include sidewalls 71 alone or in addition to the flange 72. The duct adaptor 70 may also define a recess at the first opening similar to FIGS. 5B & 5C. In some embodiments, the duct adaptor 70 may include a gasket, such as an insulation strip or seal strip, that extends along the sidewalls 71 or flange 72 to provide an improved seal when interfaced with a cover or insert.

In various embodiments, the duct adaptor 70 may include or house retention features. For example, when a retention mechanism includes magnetized retention features, the duct adaptor 70 may include a flange configured to be positioned along the outer surface around the perimeter of the duct to interface with the cover. The flange 72 or the cover may include magnets along the interface to an opposed surface attractive to the magnets. Other retention features may include a post, latch, retention slot to receive a tab or extension member.

Figure 10:
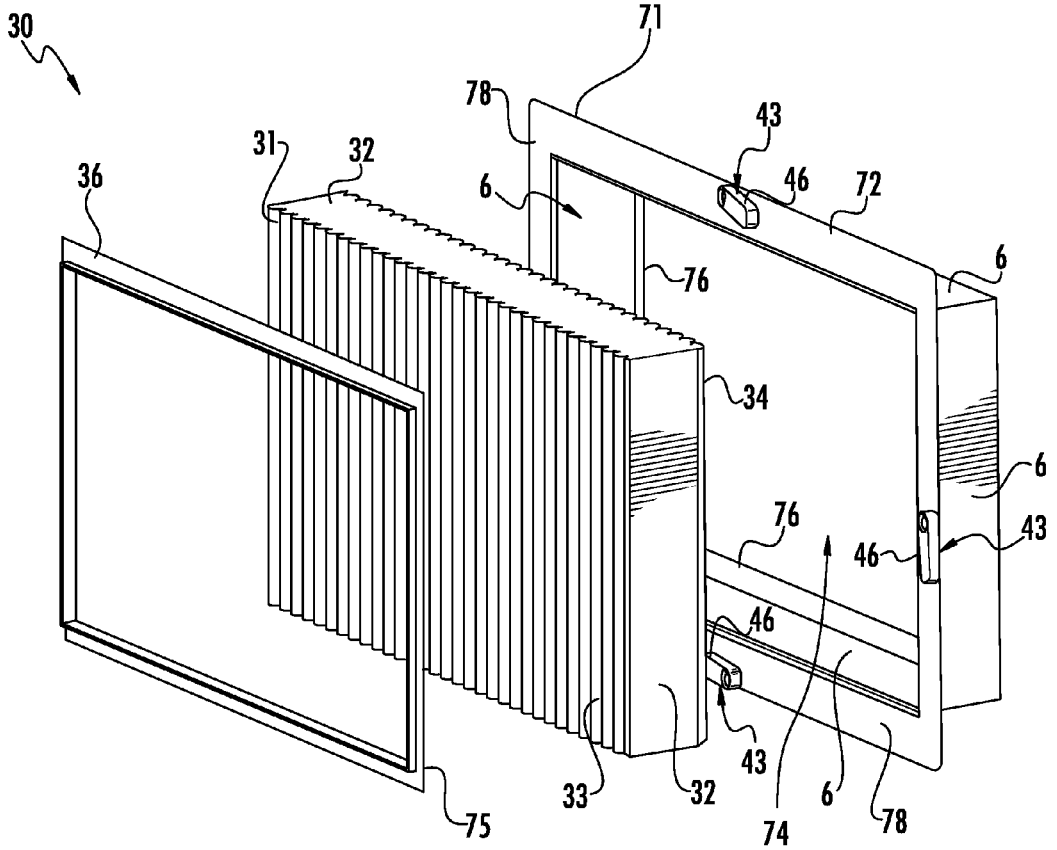
FIG. 10 illustrates an exploded view of a vent barrier system according to various embodiments.

FIG. 10 illustrates an exploded view of an embodiment of a vent barrier system 30 according to various embodiments. The system includes a duct adaptor 70, insert 31, and cover 36. The duct adaptor 70 comprises an adaptor sleeve 71, which may comprise or form a portion of the sidewalls of a duct, that defines an insert compartment 74 configured to receive and retain the insert 31. The duct adaptor 70 may be locatable or formed at an opening of a duct as described herein and thus may comprise the opening of the duct and form all or a portion of the sidewalls of the duct. As shown, the adaptor sleeve 71 includes sidewalls 6 defining the insert compartment 74. As above, the sidewalls 6 are configured to interface with the side faces 32 of the insert 31. The sidewalls 6 may be oriented to complement a dimension of the insert 31 to assist in creation of a seal therealong when the side faces 32 interface the sidewalls 6. The cover 36 may include a rim 75 dimensioned to be positioned over the opening of the insert compartment 74. The rim 75 may define a reduced cross-section or perimeter and includes a surface 76 configured to be positioned against the insert 31 when the insert 31 is positioned within the insert compartment 74. The vent barrier system 30 is also configured to secure the position of the insert 31 when the insert 31 is positioned within the compartment 74. For example, the insert compartment 74 may include an obstruction to prevent the insert 31 from extending into the duct beyond the insert compartment 74. The obstruction may be an abutment surface such as a projection, pin, cross-member, or reduced cross-section. As shown, the obstruction includes a lip 76 extending from one or more of the sidewalls 6. The lip 76 extends from the sidewalls 6 to define a cross-section or perimeter having reduced dimensions compared to the insert 31. In some embodiments, the lip 76 extends along one side of the compartment 74, such as the lower sidewall 6, or may extend a greater distance from the lower sidewall 6 than the other portions of the lip 76. The system 30 also includes a flange 72 extending from the insert compartment. The flange 72 includes retention features 43 comprising pivotable latches 46 configured to pivot over the rim 76 of the cover 36 to retain the cover 36 at the compartment 74 opening, which may comprise the duct opening when the sleeve adaptor 71 is positioned within the duct 3. When the insert 31 is positioned within the insert compartment 74, the retention features 43 may be operable to stably retain the insert 31 between the sidewalls 6, lip 76, and cover 36. In one embodiment, when retained within the insert compartment 74, the insert 31 is compressed between the lip 46 and rim 75 to form a seal. The seal may be in addition to or instead of a seal formed along the interface of the sidewalls 6 of the duct or adaptor sleeve 71 and side faces 32 of the insert 31. While the example insert 31 includes arcuate or ribbed end faces 33, 34, in other embodiments, the insert 31 may include complementary or flat surfaces along the perimeter of the insert 31 configured to interface with the lip 76 or rim 75. The duct adaptor may further define a recess 78 to receive the rim 75. The recess 78 may comprise a filleted inner edge.

Figure 11A:
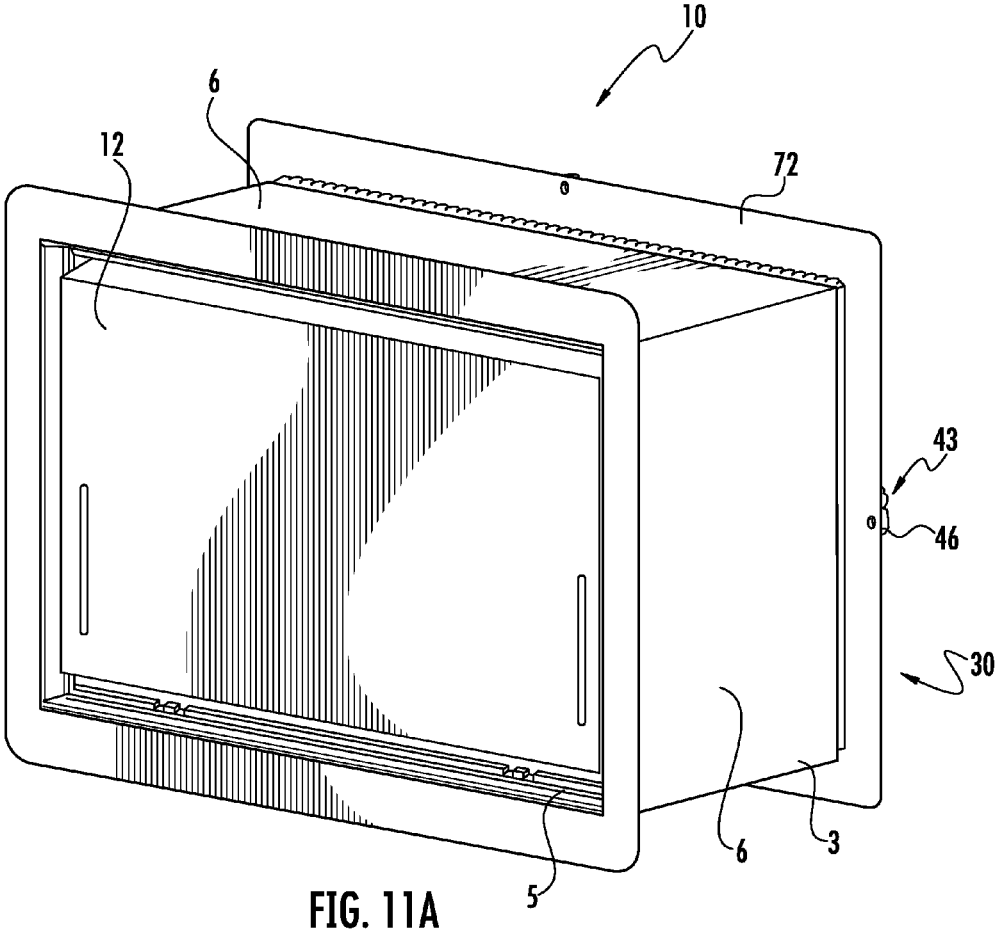
FIGS. 11A & 11B illustrate views of a vent comprising the vent barrier system of FIG. 10 according to various embodiments.
Figure 11B:
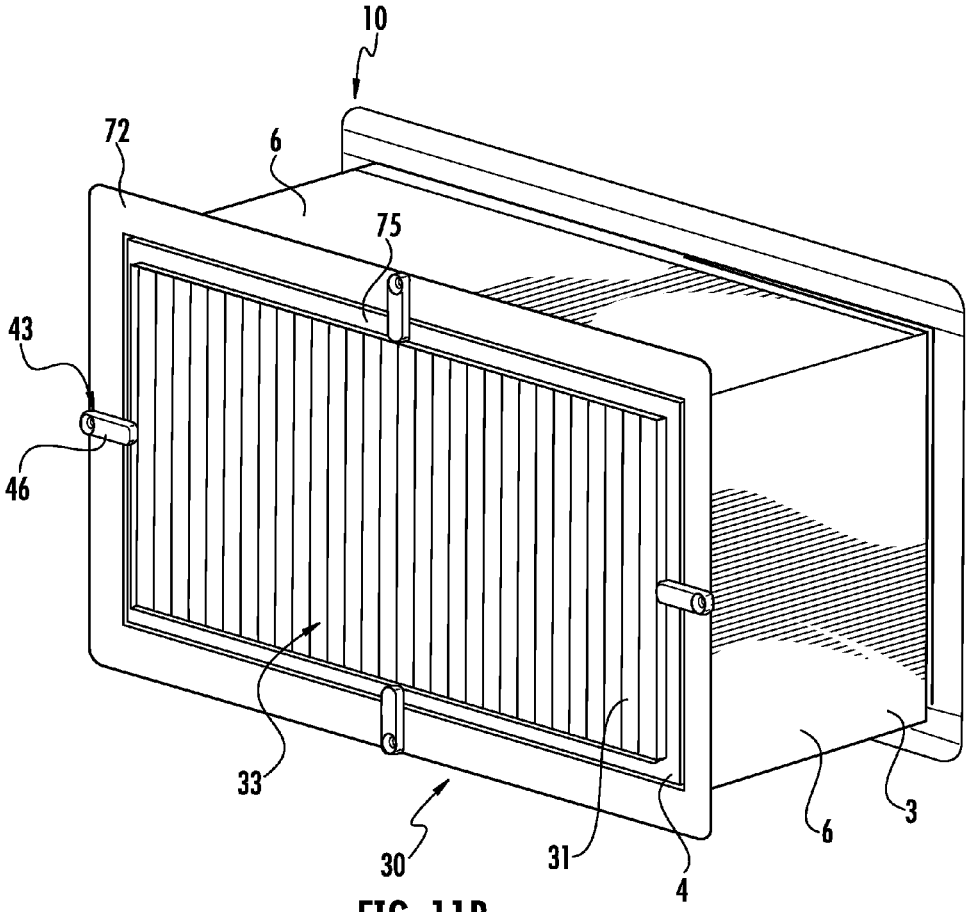

FIGS. 11A & 11B illustrate one embodiment of a flood vent 10 including the vent barrier system 30 shown in FIG. 10. In one embodiment, the sidewalls 6 of the insert compartment may extend through the duct 3 between the duct openings 4, 5. As shown, the sleeve adaptor 71 is received within the duct 3 to adapt the duct 3 for use with the insert 31 configuration. Thus, when inserted, the sidewalls 6 of the sleeve adaptor 71 form a portion of the sidewalls 6 of the duct 3. In other embodiments, the insert compartment 74 may be formed in within the duct 3 for use without an adaptor 71. The fitment of the insert compartment 74 within the duct 3 or against sidewalls 6 of the duct 3 may be tight to maintain insulation capacity. In one embodiment, the duct adaptor 70 may be provided as an adaptor to adapt a duct 3 to the use of the insert 31. The vent barrier system 30 may also be provided as a kit comprising the duct adaptor 70 and cover 36 or optionally further including the insert 31 wherein the kit is configured for retrofitting existing ducts.

FIG. 11A shows a door view is perspective of the flood vent system 10 comprising the vent barrier system 30 of FIG. 10. The door 12 may be similar to the door 12 described above and may be movable to allow flood waters to enter the duct 3. The duct 3 may be lined by sidewalls 6 extending between the openings 4, 5 of the duct 3, a portion of which may include sidewalls 6 of the insert compartment 74 formed by the duct adaptor 70. The sidewalls 6 may include a sleeve lining the duct 3 or may comprise sidewalls 6 defined in the structure. The sidewalls 6 of the insert compartment 74 (not visible) may be positioned within the duct 3, e.g., along the respective sidewalls 6. The flange 72 of the adaptor 70 may also be attached to a perimeter surface defining a duct opening in a structure.

FIG. 11B shows a perspective view of the flood vent system 10. The latches 46 are shown pivoted over the flange 72 to retain the cover 36 and insert 31 within the insert compartment 74. To remove the insert 31, the latches 46 may be pivoted to free the cover 36 and insert 31.

Figure 12:
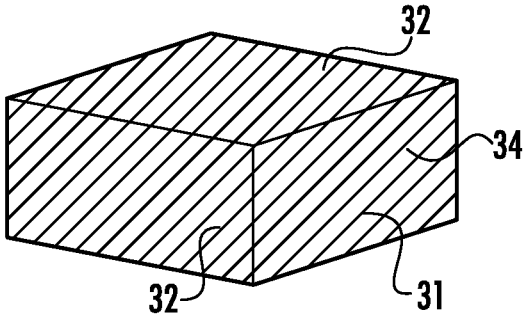
FIG. 12 illustrates an insert comprising a fluid modifiable material according to various embodiments.
Figure 13:
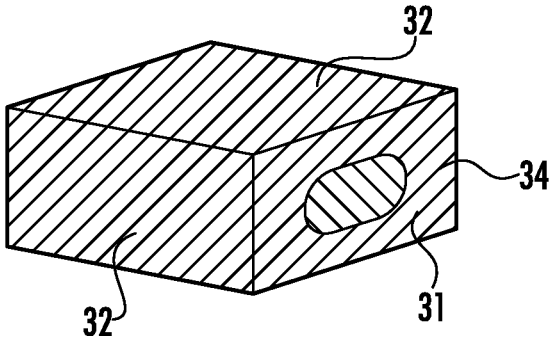
FIG. 13 illustrates an insert comprising a fluid modifiable material according to various embodiments.

In various embodiments, all or a portion of the above described inserts 31 may optionally comprise a fluid modifiable material. In such embodiments, the obstruction provided by the insert 31 may be removed via action of fluid, such as flood waters. The fluid modifiable material may be positioned to operate as a temporary seal or insulation prior to modification by fluid. For example, the fluid modifiable material may be configured to insulate or seal the duct prior to modification in addition to providing an obstruction to the opening of the door. All or a portion of the insert 31 may be formed of a fluid modifiable material. The insert 31 illustrated in FIG. 12 is formed of fluid modifiable material and is configured to dissolve entirely to allow flood waters to flow through the duct. In other embodiments, part of the insert 31 comprises fluid modifiable material. For example, the insert 31 shown in FIG. 13 comprises fluid modifiable material extending along one or more side faces 32 such that the insert 31. Upon exposure to flood waters the fluid modifiable portions are configured to deteriorate. Deterioration may reduce the size of the insert 31 to allow the insert 31 to be dislodged from the duct by the flow of flood waters.

In various embodiments, fluid modifiable materials may include gels, foams, polymers, compacts, or compressed compositions modifiable by flood waters. In some embodiments, the fluid modifiable material comprises materials configured to at least partially dissolve or breakdown upon exposure to flood waters. For example, in one embodiment, the fluid modifiable material comprises a water soluble mass such as sugars or starches or a composition comprising corn starch and a polyvinyl, for example, configured to dissolve or deteriorate when contacted by flood waters. The fluid modifiable material is preferably selected to deteriorate or dissolve sufficiently to allow flood waters to flow through the duct within about 30 minutes or less, more preferably within about 15 minutes or less, even more preferably within 5 minutes or less. The configuration of the insert may be used to assist in the rate the obstruction provided by the insert 31 is removed by flood waters. In one embodiment, the insert 31 comprises a melt-away or break-away panel. All or a portion of the panel may be configured to dissolve or deteriorate. In one embodiment, a portion of the panel may dissolve to deteriorate the structure of the panel to allow undissolved portions to break-away into flood waters. For example, an insert 31 may comprise fluid modifiable material positioned between other insulative materials such that when the fluid modifiable material is modified by water, such as by dissolving, the other material may disassociate from the insert 31 to allow flood waters to pass. In one embodiment, insulative materials that may not be generally dissolvable by water may be organized within a fluid modifiable material forming a water soluble matrix such that water exposure disassociates the matrix allowing the material to disperse. In one embodiment, the insert 31 comprises pieces or pellets of insulative material, which may not be generally dissolvable by water, mixed with the fluid modifiable material configured to dissolve when exposed to water to release the insulative materials, such as a foam, mixed therein. In one embodiment, the insert 31 comprises a melt-away or break-away panel comprising pieces or pellets, such as 1 inch×1 inch cubes, of insulative material arranged in an 16 inch×8 inch panel. In one such embodiment, the pieces, pellets, or cubes comprise insulative material, which may not be generally dissolvable by water, attached between fluid modifiable material configured to dissolve when contacted by water to disassociate the pieces, pellets, or cubes of insulative material. In another embodiment, the pieces, pellets, or cubes comprise insulative material that is a fluid modifiable material configured to dissolve to allow flood waters to pass along dissolved sections. It is to be appreciated that the fluid modifiable materials described herein may be insulative materials in addition to being fluid modifiable.

In one embodiment, an insert 31 may be adhered to the sidewalls of the duct via an adhesive configured to dissolve or deteriorate upon exposure to flood waters such that the insert 31 may dislodge from the duct. For example, a fluid modifiable adhesive, such as a water soluble adhesive, may be used to retain the insert 31 within the duct until the adhesive action of the adhesive is sufficiently deteriorated by flood waters.

This disclosure describes various elements, features, aspects, and advantages of various embodiments of the stopping systems, apparatuses, and methods thereof. It is to be understood that certain descriptions of the various embodiments have been simplified to illustrate only those elements, features and aspects that are relevant to a more clear understanding of the disclosed embodiments, while eliminating, for purposes of brevity or clarity, other elements, features and aspects. Any references to "various embodiments," "certain embodiments," "some embodiments," "one embodiment," or "an embodiment" generally means that a particular element, feature and/or aspect described in the embodiment is included in at least one embodiment. The phrases "in various embodiments," "in certain embodiments," "in some embodiments," "in one embodiment," or "in an embodiment" may not refer to the same embodiment." Furthermore, the phrases "in one such embodiment" or "in certain such embodiments," while generally referring to and elaborating upon a preceding embodiment, is not intended to suggest that the elements, features, and aspects of the embodiment introduced by the phrase are limited to the preceding embodiment; rather, the phrase is provided to assist the reader in understanding the various elements, features, and aspects disclosed herein and it is to be understood that those having ordinary skill in the art will recognize that such elements, features, and aspects presented in the introduced embodiment may be applied in combination with other various combinations and sub-combinations of the elements, features, and aspects presented in the disclosed embodiments. It is to be appreciated that persons having ordinary skill in the art, upon considering the descriptions herein, will recognize that various combinations or sub-combinations of the various embodiments and other elements, features, and aspects may be desirable in particular implementations or applications. However, because such other elements, features, and aspects may be readily ascertained by persons having ordinary skill in the art upon considering the description herein, and are not necessary for a complete understanding of the disclosed embodiments, a description of such elements, features, and aspects may not be provided. As such, it is to be understood that the description set forth herein is merely exemplary and illustrative of the disclosed embodiments and is not intended to limit the scope of the invention as defined solely by the claims.

The grammatical articles "one", "a", "an", and "the", as used in this specification, are intended to include "at least one" or "one or more", unless otherwise indicated. Thus, the articles are used in this specification to refer to one or more than one (i.e., to "at least one") of the grammatical objects of the article. By way of example, "a component" means one or more components, and thus, possibly, more than one component is contemplated and may be employed or used in an implementation of the described embodiments. Further, the use of a singular noun includes the plural, and the use of a plural noun includes the singular, unless the context of the usage requires otherwise.

It will be further appreciated that for conciseness and clarity, spatial or relative terms such as "vertical," "horizontal," "upper," "lower," "lateral," "longitudinal," and others may be used herein with respect to the illustrated embodiments. However, vents 10 may be used in many orientations and positions, as such, these terms are not intended to be limiting and absolute. All numerical quantities stated herein are approximate unless stated otherwise, meaning that the term "about" may be inferred when not expressly stated. Additionally, in some illustrative embodiments, dimensions including a parameter, measurement, diversion, or range may be given. It is to be understood that any such parameter, measurement, diversion, or range is provided as an illustrative example or instance of an embodiment and is not intended to limit that or other embodiments. For example, unless otherwise specified, illustrations of dimensions and how such parameters or measurements of such dimensions relate to other parameters, e.g., with respect to movement, support, engagements, interfacing dimensions are provided to aid the reader's understanding of the features and may not be illustrated to scale nor universally applicable to every embodiment.

What is claimed is:

1. A vent barrier system comprising:

an insert comprising side faces extending between a first end and a second end of the insert, wherein the insert is dimensioned to be inserted within a flood vent duct through a first opening such that the side faces contact sidewalls of the duct and provide an insulative seal between the first opening and a second opening of the duct when inserted therein;

a cover having a first side and a second side configured to be attached to the first face of the insert, wherein the cover is dimensioned to be selectively securable to the duct at the first opening, wherein the cover is manipulatable to selectively remove the insert from the duct; and a door positioned at the second opening of the duct;

wherein the insert is dimensioned to extend within the duct and prevent the door positioned at the second opening of the duct from opening in a first direction when inserted therein, wherein the insert is dimensioned such that a second face is located adjacent to the door when inserted within the duct to prevent the door from moving from a closed position to an open position, wherein the door is configured to open in a second direction when the insert is inserted therein.

2. The vent barrier system of claim 1, wherein the second side of the cover is attached to the first face of the insert by an adhesive.

3. The vent barrier system of claim 1, further comprising a retention member configured for selectively securing the cover at the first opening of the duct.

4. The vent barrier system of claim 3, wherein the retention member comprises one of a latch and a bolt movable to secure and release the cover from the first opening of the duct.

5. The vent barrier system of claim 4, wherein one of the duct, the cover, and the insert include a retention slot positioned to receive the latch or bolt when moved to secure the cover at the first opening of the duct.

6. The vent barrier system of claim 1, wherein the second side of the cover includes an outer perimeter surface configured to seal with a surface extending along an exterior perimeter of the first opening when the insert is inserted within the duct.

7. The vent barrier system of claim 6, wherein one of the outer perimeter surface of the second side of the cover and the surface extending along the exterior perimeter of the first opening comprise a gasket configured to compressingly seal with the adjacent surface when the cover is secured to the duct at the first opening.

8. The vent barrier system of claim 1, wherein the cover includes a handle positioned at the first side of the cover configured to be gripped by a user to manipulate the cover.

9. The vent barrier system of claim 1, further comprising a duct adaptor configured to adapt the vent to the dimensions of at least one of the cover and the insert.

10. The vent barrier system of claim 9, wherein the duct adaptor is configured to be positioned within the duct and form at least a portion of the sidewalls of the duct such that the sidewalls sealing engage the side faces of insert for a tight fit when the insert is inserted within the duct.

11. The vent barrier system of claim 9, wherein the duct adaptor includes a flange configured to be positioned along an exterior perimeter of the first opening, and wherein the flange comprises a surface configured to engage the second face of the cover and form a seal therebetween when the cover is secured to the vent at the first opening.

12. The vent barrier system of claim 11, wherein the duct adaptor further includes a recess dimensioned to receive the cover, and wherein the recess includes a base comprising the flange.

13. A flood vent barrier, the barrier comprising:

an insert comprising side faces extending between a first end and a second end of the insert, wherein the insert is dimensioned to be inserted within a flood vent duct through a first opening such that the side faces contact sidewalls of the duct and provide an insulative seal between the first opening and a second opening of the duct when inserted therein; and a fluid modifiable material forming at least a portion of the insert, wherein the fluid modifiable material is configured to be modified when contacted by water such that the modification occurs within 30 minutes or less after being contacted by water and removes the insulative seal provided by the insert to allow water to flow through the duct between the first opening and the second opening, wherein the fluid modifiable material comprises one or more of a sugar, a starch, and a combination of a corn starch and a polyvinyl, wherein the fluid modifiable material is configured to deteriorate when contacted by water such that a dimension of the insert reduces to allow the insert to be dislodged from the vent by water flowing into the duct through at least one of the first opening and the second opening, wherein the fluid modifiable material is configured to dissolve when contacted by water.

14. An sealing kit for providing a substantially air tight seal between a first opening and a second opening of a flood vent duct, the kit comprising:

a duct adaptor dimensioned to be positioned at the first opening, the duct adaptor having sidewalls defining an interior perimeter of the duct and extending from a first end positioned at the first opening to a second end positioned toward the second opening of the duct, an abutment extending interiorly from the second end of at least one sidewall, wherein the sidewalls and abutment define a compartment dimensioned to receive an insert therein;

a cover defining a rim configured to be selectively secured at the first end of the duct adaptor to retain the insert when the insert is positioned within the compartment, wherein the insert provides a substantially air tight seal between the first end of the duct adaptor and the second opening of the duct when the insert is retained within the compartment; and the insert, wherein the insert comprises a fluid modifiable material configured to one of deteriorate and dissolve within 30 minutes or less after being contacted by water present at one of the first end and the second end of the duct adaptor to remove the substantially air tight seal to allow water to flow through the duct, wherein the fluid modifiable material comprises one or more of a sugar, a starch, and a combination of a corn starch and a polyvinyl.

15. The kit of claim 14, further comprising a retainer mechanism configured to selectively secure the cover at the first end of the duct adaptor, wherein the retainer mechanism comprises one of an extendable bolt, a latch, and a slot configured to receive a retention member.

* * * * *